United States Patent [19]

Belland

[11] Patent Number: 4,738,285

[45] Date of Patent: Apr. 19, 1988

[54] BEVERAGE DISPENSER FOR CUPS AND PITCHERS WITH MANUAL START AND AUTOMATIC SHUT OFF

[75] Inventor: Terrance G. Belland, Champlin, Minn.

[73] Assignee: The Cornelius Company, Anoka, Minn.

[21] Appl. No.: 880,464

[22] Filed: Jun. 30, 1986

[51] Int. Cl.[4] ..... B65B 3/04

[52] U.S. Cl. ..... 141/1; 141/95; 141/198; 141/87; 141/361; 141/367; 141/378

[58] Field of Search ..... 141/86–88, 141/94–96, 369–381, 100–107, 192–229, 250–284, 351–362, 367, 84, 368, 1–12

[56] References Cited

U.S. PATENT DOCUMENTS 4,236,553 12/1980 Reichenberger ..... 141/95

*Primary Examiner*—Houston S. Bell, Jr.

*Attorney, Agent, or Firm*—Henry C. Kovar

[57] ABSTRACT

An improved beverage dispenser for filling any one receptacle taken from a predetermined group of different sized cups or a significantly large pitcher, the dispenser has manual start and automatic shut off of dispensing utilizing an electrically conductive combination activator and beverage probe lever, has an improved receptacle rest for dependable support of all of the cups or the pitcher, and the rest has a rearwardly inclined tilted upper receptacle support surface to tilt the receptacle toward the lever. The improved receptacle rest has a nose extending up and out beyond a dispenser drip tray for support of the pitcher, and a backstop to prevent the pitcher from damaging or disabling the automatic shut off and the dispenser. A method of dispensing, a retrofit kit, and method of retrofitting a cup dispenser into a dipenser for cups and/or pitchers with automatic dispensing shut off are also provided.

23 Claims, 1 Drawing Sheet

BEVERAGE DISPENSER FOR CUPS AND PITCHERS WITH MANUAL START AND AUTOMATIC SHUT OFF

BACKGROUND OF THE INVENTION

1. Field of the Invention

This invention pertains to a new and improved method and structure for filling any beverage receptacle from a plurality of cups or a pitcher with beverage, and having manual start and automatic shut off of dispensing when the beverage level reaches or approaches the rim of the beverage receptacle.

2. The Prior Art

The use of a tilted open topped receptacle for filling has been well known and used since at least as early as the 1900's.

U.S. Pat. No. 763,136 has a continuous canning line wherein open top cans are filled firstly with solids and then secondly with liquid. The filled can is then tilted to spill out any excess liquid so that when the cans leave the tilting area and are returned to vertical, the cans all have an identical fill and identical head space. The cans are thereafter topped and closed.

Subsequent canning lines have been utilized wherein the open topped cans are filled while tilted. Cans are now being filled with liquids, mixtures of solids and liquids, and flowable solids while tilted. When the cans are returned to upright, even and consistant fills and head spaces are provided regardless of can size. Examples of state-of-the-art fillers of tilted cans and bottles are made by Soborn Corporation of Fairfield N.J. and a typical specific example is shown in B. C. Eisenberg U.S. Pat. No. 4,349,053.

W. C. Buttner et al U.S. Pat. No. 2,055,923 taught that a glass or like beverage receptacle should be placed beneath a pour spout and disposed at an angle or tilt from vertical and to the spout so that beverage discharged from the spout will hit the side of a glass at a slight angle to minimize carbonation loss and foaming.

S. D. Levings U.S. Pat. No. 2,598,665 teaches a carbonated soft drink dispenser having a cup support which will hold the cup at an angle with respect to the user and with respect to vertical, and to the dispenser so that the forward side of the cup is slightly higher than the back, serving to confine any overflow to the rear of the cup and improve the appearance of the cup of beverage after filing. The cup is canted rearwardly at an angle of approximately 10 degrees. The cup has its rear top edge below the bottom of a dispensing nozzle.

Both Buttner and Levings were assigned to Bastian Blessing Co. of Chicago.

Lawrence D. McIntosh U.S. Pat. No. 3,916,963 is also directed to beverage dispensing and teaches the concept of and structure for manual start and automatic shut off of dispensing by utilizing an electrically conductive combination actuator and beverage probe lever that engages a cup and electrically contacts and senses the beverage when it reaches or approaches the rim of the cup.

Arthur M. Reichenberger U.S. Pat. No. 4,236,553 is a further development beyond McIntosh. Reichenberger provided energization of the beverage and signal current flow through the flowing beverage stream during dispensing, through the beverage in the cup and to the combination actuation and beverage probe lever. An elongate, straight electrically conductive actuator and probe lever has a sliding angled projection to engage the beverage in various heights of cups. This particular device was never able to satisfy NSF sanitation criteria and while having been field tested and found operable, it has not been commercially successful as of this date.

D. E. Holcomb et al in co-pending U.S. Ser. No. 824,819 filed on Jan. 31, 1986, have devised an improved McIntosh type structure with a low moment combination actuator and beverage prove lever utilizing a high strength low mass tubular lever arm mounted on a di-electric journal to give improved electrical isolation. A heater element in the lever arm provides high temperature which can keep the lever arm sterile. Holcomb further shows and teaches that the use of a relatively simple tilted cup rest with a McIntosh type automatic filling control is well known.

F. Brill U.S. Pat. No. 3,913,792 has a receptacle rest with a bottom mounted stop on a horizontal support surface for stopping a variety of cups below a nozzle. Brill's stop acts directly upon the bottom of a cup.

Where we are with McIntosh, Reichenberger and Holcomb is that we have a device that will now automatically shut off with various sized cups or glasses, regardless of the size of the cup, provided the cups are of reasonable height and volume and they fit upon and in the dispenser. Specifically medicine cups and popcorn buckets are not usable, but typical beverage cups in the range of 6–16 ounces are quite acceptable. While these devices have offered measurable and economically important savings of time and increases in productivity, further opportunities and problems have been realized.

Many of the beverage and food establishments serve dispensed beverage in cups or glasses and significantly larger pitchers. For example, draft beer retailers will sell small glasses, mugs, and/or large pitchers of beer. Soft drink retailers such as pizza parlors and hamburger houses will serve small and medium and large cups and also very large pitchers of soft drinks. The cups are typically of paper and are relatively lightweight, collapsible, and of low strength. The pitcher is usually glass or plastic and weights at least a couple of pounds. A filled pitcher of soft drink might easily weigh up to 6 pounds.

The devices of McIntosh, Reichenberger and Holcomb have not worked reliably with pitchers. When a pitcher is placed upon the cup rest the pitcher is too large and may fall off of the cup rest, therefore requiring that the pitcher be manually held in place during filling whereupon the automatic shut off feature and structure becomes redundant because there is no productivity increase or labor savings. Then the pitcher is so heavy and bulky that it bends the actuator and probe levers, and/or breaks the actuator switches connected to the levers after which the dispenser will not work. Further its been found that the relatively heavy filled pitcher tends to slide down on the inclined cup rest and again bend the lever, break the actuator switch, or bend the dispensing valve mount. Most dispensers have a stainless steel splash panel behind the cup rest and the dispensing valves. If and when the combination beverage probe and actuator lever is pushed against the splash panel by a pitcher, the automatic fill control is disabled by electrical shunting.

These problems have not yet been addressed or solved, and as of this date there is no known automatic fill control that will work and be commercially satisfactory with pitchers and a variety of cups or glasses.

There are thousands of beverage dispensers presently in use, that require the constant attention and attendance of a foodservice employee during filling of pitchers. This is an undesirable and relatively costly and inefficient usage of employee time. A solution to the problems of filling pitchers and cups needs to be found, and a solution enabling retrofit of existing dispensers so that they will automatically dispense into either cups or pitchers needs to be undertaken.

OBJECTS OF THE INVENTION

It is an object of the present invention to provide an improved dispenser structure and method for dispensing beverage into any receptacle taken from a predetermined group of cups and a pitcher, with manual start and automatic shut off of dispensing.

It is an object of the present invention to provide a new beverage receptacle rest for a beverage dispenser, wherein the receptacle rest has an improved structure for accomodating any beverage receptacle taken from a predetermined group of cups and a pitcher.

It is an object of the present invention to provide structure and a method of retrofitting an existing beverage dispenser for filling cups, into an improved beverage dispenser for filling any beverage receptacle taken from a predetermined group of cups and a pitcher, with manual start and automatic shut off of the dispensing after retrofit.

It is an object of the present invention to provide a new and improved method of dispensing beverage into an open topped beverage receptacle taken from a predetermined group of cups or a significantly larger pitcher, with manual start of dispensing and automatic shut off of dispensing when beverage in the receptacle reaches or approaches a receptacle rim, regardless of whether a cup or a pitcher is being filled.

SUMMARY OF THE INVENTION

According to the principles of the present invention, an improved beverage dispenser for filling cups or a pitcher has a housing with a drip tray, an electric dispensing valve, a valve actuator having an electrically conductive beverage sensing probe, an automatic control for stopping dispensing when the selected receptacle is filled to its rim, and an improved receptacle rest having an inclined receptacle support extending upward and outward beyond the drip tray for support of the pitcher.

An improved beverage dispenser for filling cups or pitchers with structure for manual start and automatic shut off when the beverage level reaches or approaches the rim of the selected receptacle, having an improved receptacle rest with an inclined receptacle support surface and a backstop for holding up tilted cups and pitchers so they do not damage the dispenser.

An improved receptacle rest for a beverage dispenser has an upward facing receptacle support, front and rear rest supports for engaging the dispenser, and a nose on the receptacle support surface which is co-planar with the receptacle support surface which extends upward and outward beyond the front rest support.

An improved receptacle rest for a beverage dispenser has an inclined receptacle support surface for support of a tilted cup or pitcher, a forward facing backstop for stopping rearward motion of the pitcher and for supporting filled pitchers on the inclined surface.

A kit for retrofitting a cold carbonated beverage dispenser for manually filling cups into an improved dispenser for filling cups and pitchers with manual start and automatic shut off of dispensing has an improved dispensing valve with manual start and electronic automatic shut off structure that senses when the beverage level reaches or approaches the receptacle rim, and an improved receptacle rest installable upon the dispenser drip tray, the receptacle rest has an inclined receptacle support surface which extends upward and outward past the drip tray for support of the pitcher.

A method of retrofitting a cold beverage dispenser for cups into an improved dispenser for filling cups or pitchers with manual start and automatic shut off of the dispensing has the steps of removing the cup rest and at least one of the dispensing valve actuators, installing a new electrically conductive combination actuator and beverage probe lever to replace the removed lever, installing an electronic control to shut off dispensing when the lever senses beverage reaching or approaching the receptacle rim, and installing an improved inclined receptacle rest that extends forward of and upward of the front of the drip tray for support of the pitcher.

A method of retrofitting a dispenser, as just previously described, includes the step of installing an improved receptacle rest and structure for limiting rearward movement of the cups and pitchers and for support of a filled pitcher so it cannot slide downwards and backwards on the inclined receptacle rest.

A method of dispensing beverage into any receptacle selected from a group of cups or a pitcher, has the steps of placing the selected receptacle on a rearwardly tilted receptacle support, moving the tilted receptacle rearward and downward on the support and pushing back a combination actuation and beverage level probe to start dispensing, stopping rearward movement of the tilted receptacle with a backstop to prevent bending of the actuator and probe, electrically sensing the dispensed beverage when it reaches or approaches the rim of the cup or the pitcher and shutting off dispensing, and holding the filled receptacle in place upon the individual support surface so it cannot slide backwards and downwards.

Many other advantages, features and additional objects of the present invention will become manifest to those versed in the art upon making reference to the detailed description and accompanying drawings in which the preferred embodiment incorporating the principles of the present invention is set forth and shown by way of illustrative example.

DESCRIPTION OF THE PREFERRED EMBODIMENT

Figure 1:
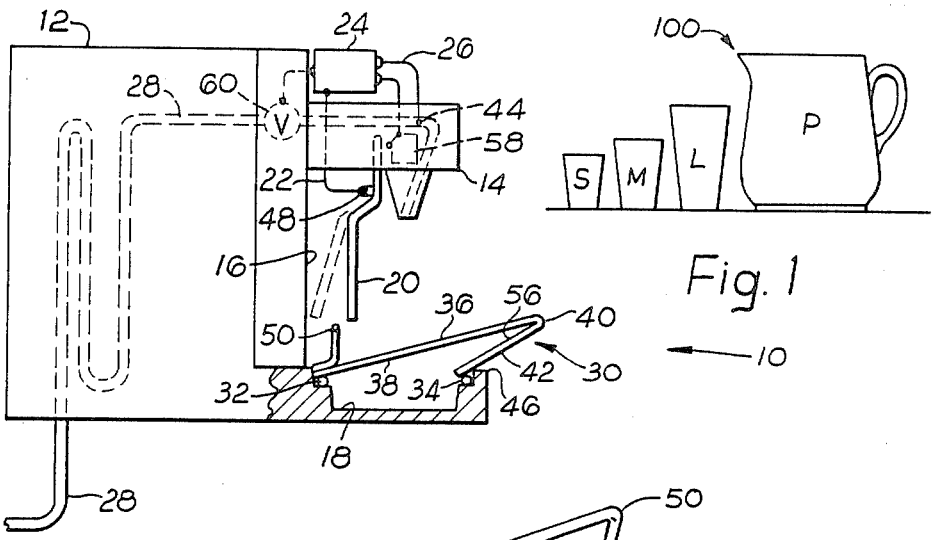
FIG. 1 is an elevational side view in partial section of the improved beverage dispenser of the present invention.
Figure 3:
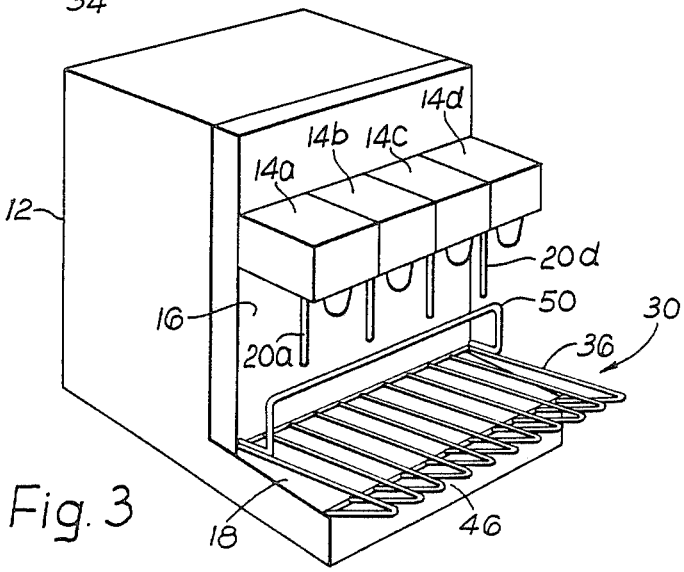
FIG. 3 is a perspective view of the improved beverage dispenser of FIG. 1.

The preferred embodiment of the improved beverage dispenser of the present invention is shown in FIGS. 1 and 3 and is generally indicated by the numeral 10.

The dispenser 10 has a housing 12 supporting at least one and most often a plurality of side-by-side dispensing valves 14. Current industry practice is to align from four to twelve dispensing valves 14 side-by-side, and the valves 14 are usually mounted on and/or atop of a sanitary stainless steel splash panel 16 which extends downward from the back of the valves 14 to a drip tray 18 underneath the valves 14.

The valves 14 are beverage dispensing valves and a preferred dispensing valve is the valve in F. L. AUSTIN U.S. Pat. No. 4,549,675 and has an automatic dispensing shut off control and system as is taught by L. D. McIntosh U.S. Pat. No. 3,916,963 and D. E. Holcomb et al U.S. Ser. No. 824,819, now pending.

This preferred dispensing valve 14 has an electrically conductive combination dispensing actuator and beverage level probe lever 20 which will hereinafter simply be referred to as the lever 20. An electrical lead 22 connects an electrical terminal 48 on the lever 20 to an automatic fill control 24 having a second lead 26 into a probe 44 in a beverage supply line 28 which extends through the dispensing valve 14. The lever 20 is mechanically connected to a conventional actuator switch 58 which starts dispensing by latching a relay or solid state equivalent (not shown) to open a solenoid controlled NC valve 60 in the beverage supply line 28. The lever 20 is pushed rearward by a beverage receptacle to effect operation of the switch and 58 and to start dispensing. If the lever 20 is released and allowed to come forward, dispensing is stopped when the lever 20 is allowed to return forward.

When a beverage receptacle is manually pushed against the lever 20 and the lever 20 is pushed rearward, dispensing is manually started. The receptacle is left in place and when the beverage level in the receptacle reaches or approaches a rim of the receptacle, the beverage and/or its foam which is a constituent of the beverage, makes physical contact with the lever 20 and electrical continuity is provided to the control 24 via the electrical leads 22, 24 and through the dispensed beverage in the receptacle and through the lever 20 and the probe 44. Upon sensing the beverage at the rim of the receptacle by sensing this continuity through the beverage in the receptacle, the control 24 stops dispensing of beverage and the receptacle is filled to its rim.

Figure 2:
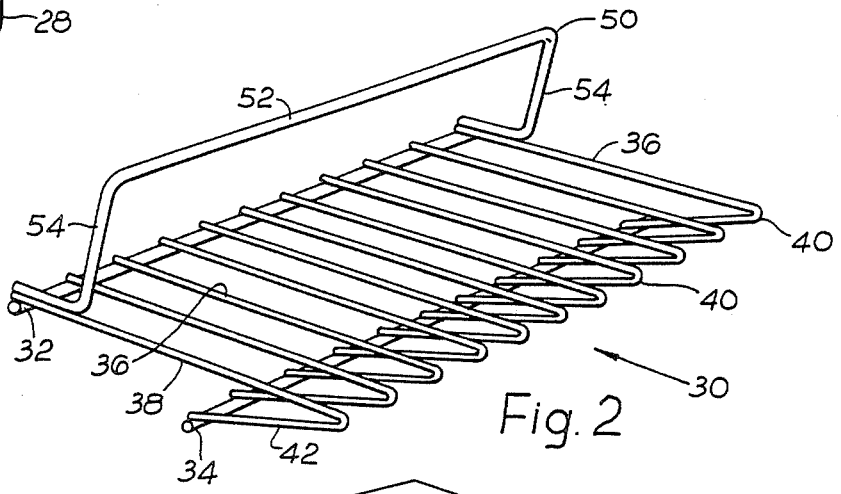
FIG. 2 is a perspective view looking down at the improved beverage receptacle rest of the present invention.

An important feature of the present invention is the new and improved beverage receptacle support rest shown in FIGS. 1–3 and generally indicated by the numeral 30 and hereinafter referred to as the rest 30.

The rest 30 has a rear support member 32, and a front support member 34 which is spaced forward of the rear support member 32. An inclined receptacle support surface 36 is on the top of the rest 30 and faces upwards and backwards towards the dispensing valves 14 and the levers 20. The receptacle support surface 36 is formed by a plurality of support surface wires 38 which extend upward and forward from the rear support 32. The support surface wires 38 and the receptacle support surface 36 both extend upwardly, over and forward of the front support member 32 and a front rim 46 of the drip tray 18, to a nose 40 which is the highest part of the receptacle support surface 36. A vertical support wire 42 extends back from the acute angled nose 40, which is radiused and blunted as shown, to the front support member 34 which rests upon the front rim 46. The respective support surface wires 38 and vertical support wires 42 are preferably contiguous and both extend rearward and downward in an acute included angle from the radiused end and blunted nose 40. These V-shaped wires 38, 42 are secured in the rest 30 one beside another across the transverse width of the rest 30. The preferred angle of incline on the receptacle support surface 36 is ten degrees, although more or less will also work and in fact may be desirable if a peculiar and/or unique beverage receptacle is to be used.

On the back side of the improved beverage receptacle support rest 30 is a new and novel receptacle backstop 50 having a forward facing stop surface 52 which extends transversly behind and preferably below the actuator levers 20. The backstop 50 is an inverted U-shaped rod which extends across the width of the rest 30 and which has downward extending legs 54 which are welded to the outermost support surface wires 38. The backstop 50, as best seen in FIG. 1, is inclined forward with respect to the receptacle support surface 36 so that the backstop 50 is vertical or pitched slightly forward. The stop surface 52 is underneath the bottom of the levers 20 so that the levers 20 can be pivoted over the top of the backstop 50.

The backstop 50 is spaced upward off of and from the receptacle support surface 36 so that it makes contact with a receptacle well above the bottom of the receptacle, and the backstop 50 is preferrably about two and one-half inches above the receptacle support surface 36. The full diameter of a beverage receptacle is then contacted by the stop surface 52 rather than a base of the beverage receptacle, because with both cups and pitchers, the base is usually smaller than the receptacle body diameter. The backstop 50 stops the rearward and downward movement of the beverage receptacle before the lever 20 has completed its travel, so that the lever 20 will not be bent nor the actuator switch 58 broken, nor the lever 20 shunted out to the splash panel 16. An optional imperforate splash pan 56 extends transversely across the width of the rest 30, and slopes downward from the nose 40 to the front support member 56 for diverting spilled beverage from in front of the drip tray 18 back and into the drip tray 18. The rest 30 preferrably has a di-electric outer surface, such as nylon plastic, for prevention of electric cross-flow between various dispensing valves 14, when wet pitchers are being filled.

This improved dispenser 10 and receptacle rest 30 enable extremely efficient and accurate dispensing into any one of a predetermined group 100 of cups (or glasses) or a pitcher. For example, a group of cups being small, medium and large at 6, 12 and 20 oz. respectively, and a pitcher of 60 oz. or more can interchangably be utilized as a group 100 of beverage receptacles for being filled by the dispenser 10 on the rest 30. Any of these receptacles 100 can be taken and filled on the dispenser 10. Dispensing is manually initiated by placing the selected beverage receptacle on the inclined support surface 36 and pushing the tilted receptacle rearward and downward on the support surface 36 into the lever 20, and then pushing the receptacle further to pivot the lever 20 over the top of the backstop 50 until the receptacle is stopped by the backstop 50. Dispensing has been started by manual movement of the lever 20 by the receptacle. When the level of dispensed beverage in the selected receptacle reaches or approaches the back and lowermost part of the rim of the receptacle, the beverage climbs the receptacle rim and contacts the lever 20 whereupon the beverage establishes continuity for the control 24 and dispensing is automatically stopped regardless of whether the selected receptacle was one of the cups or the pitcher. The pitcher is fully supported by the nose 40 even though it's too large for the dispenser 10 and the drip tray 18 and the pitcher extends off of and beyond the drip tray 18. The pitcher can now be very assertively put on and pushed into the dispenser 10, as the young employees who typically work fast food stores tend to do, with no fear of breaking the dispensing valve 14 or the lever 20 or of disabling the automatic shut off feature and structure. The relatively large diameter of the base of the filled pitcher is also completely supported and is held up so that it doesn't slide down the inclined receptacle support surface 36 and cause damage or malfunction. The relatively small cups can no longer be pushed in between the levers 20 and cause problems. Spillage beyond the drip tray 18 is fed back into the drip tray 18 by the splash panel 56.

Needless to say, there are thousands of existing beverage dispensers which are in service in fast food retailers, and many of these retailers use cups and pitchers in which to serve dispensed beverage. These existing dispensers fill only cups, and have no automatic shut off, and the dispenser with automatic shut off will not work with pitchers.

A kit for retrofitting an existing beverage dispenser for filling cups into the improved dispenser 10 of the present invention, will have a new lever 20 and control 24 and leads 24, 26, together with the improved receptacle rest 30 and the probe 44. The lever 20, control 24, and leads 24, 26 and probe 44will preferably be embodied in a replacement beverage dispensing valve 14. To retrofit an existing dispenser, at least one old actuator lever and the old cup rest (not shown) are removed and discarded. If the valve is to be replaced, at least one old valve is removed. The new lever 20, the control 24 and leads 16, 24 are installed, preferrably in the new valve 14 and are operatively connected to the probe 44, and the improved receptacle rest 30 is installed. The old dispenser, for filling cups only, will now fill either cups or pitchers with manual start and completely automatic shut off regardless of which of the group q receptacles 100 is selected and placed on the rest 30 for filling. Typically in a retrofit, most or all of the original dispensing valves will be connected new valves 14.

The time savings and efficiency improvements and cost reductions are quite impressive. All of the dispensing valves 14 can be operated at one time and all will automatically shut off when the respective cup or pitcher is filled to the rim, regardless of where the rim is. It typically takes 45–60 seconds to fill a pitcher, during which time the salesperson can now turn their back on the automatic dispenser 10 and serve customers and do useful, expedient, customer satisfying, and revenue producing activities. Many retailers find they can get by with less employees. The improved and/or retrofitted dispenser 10 as seen in FIG. 3 can have receptacles placed at all valves 14. For example, the retailing employee can put a small cup 100S into the first dispensing valve **14*a*, a medium cup 100M into the second dispensing valve 14*b*, a large cup 100L into the third valve 14*c*, and a pitcher 100P on the fourth valve 14*d*. The employee can then go serve food, take another order, give change, take money or do another activity, and in due time turn around and find all of the cups 100S, 100M, 100L and the pitcher 100P filled to their respective rims and ready to be removed from the dispenser 10** and passed to the customer. This is a significant productivity improvement.

This invention is extremely useful firstly with soft drinks, secondly with beer, and then with ice tea, wines, wine coolers, non-alcoholic beer substitutes and other beverages.

Although other advantages may be found and realized and various modifications may be suggested by those versed in the art, it should be understood that I wish to embody within the scope of the patent warranted hereon, all such embodiments as reasonably and properly come within the scope of my contribution to the art.

I claim as my invention:

1. An improved beverage dispenser for filling any individual receptacle from a predetermined receptacle group of cups and a pitcher, with automatic shut off of the dispensing, comprising (a) a dispenser housing with a drip tray and an electrically operable beverage dispensing valve;

(b) a dispensing valve actuator having an elongate electrically conductive combination beverage probe and dispensing actuator lever hanging downward from a journal which is at a level above the drip tray for engaging an upper rim of said any receptacle;

(c) a dispensing switch operable by said actuator and connected to effect opening of said dispensing valve upon movement of the combination probe and lever by said any individual receptacle being thrust against the actuator;

(d) automatic control means electrically disposed in combination with the dispensing switch and the dispensing valve for effecting closing of the valve and stopping of dispensing when the level of dispensed beverage in said any individual receptacle reaches or approaches the upper rim of the said receptacle and touches the probe and the dispensed beverage level is thereby electrically sensed by the control; and (e) an improved receptacle rest between the drip tray and the lever, said receptacle rest having a generally monoplanar rearwardly inclined upper receptacle support surface which extends outward to a nose, said nose being forward of and upward beyond a front rim of the drip tray, for complete and stable support of said any individual receptacle(s) thereon above and spaced from said drip tray, and in the case of the pitcher at least partially outside of the drip tray.

2. The apparatus of claim 1, in which the receptacle support surface is formed of a plurality of acute angled wires having a rear leg extending down from the nose and secured to a rear transverse member and a front leg extending down from the nose and over the top of the drip tray and secured to a front transverse member, the front member being below and to the rear of the nose.

3. The apparatus of claim 1, including a transverse splash pan sloping downward from the nose to the drip tray front rim and over the top of the front rim.

4. The apparatus of claim 1, including a receptacle backstop for the pitcher spaced from and in between the lever and the receptacle support surface for abutting and holding up a filled receptacle, said backstop being spaced forward of a dispenser splash panel and being behind the lever.

5. An improved beverage dispenser for filling any individual receptacle from a predetermined receptacle group of cups and a pitcher, with automatic shut off of the dispensing, comprising (a) a dispenser housing with a drip tray and an electrically operable beverage dispensing valve;

(b) a dispensing valve actuator having an elongate electrically conductive combination beverage probe and dispensing actuator lever hanging downward from a journal for engaging the upper rim of said any receptacle and which is at a level above the drip tray;

(c) a dispensing switch operable by said lever and connected to effect opening of said dispensing valve upon movement of the lever by said receptacle being thrust against the actuator;

(d) automatic control means electrically disposed in combination with the dispensing switch and the dispensing valve for effecting closing of the valve and stopping of dispensing when the level of dispensed beverage in said receptacle reaches or approaches an upper rim of the receptacle and the beverage is electrically contacted by the probe and is electrically sensed by the control;

(e) a receptacle rest over the drip tray and below the actuator lever, said rest having a generally planar receptacle support surface which is tilted rearwardly toward the lever; and (f) backstop means spaced from and above the tilted receptacle support surface for abuttingly engaging and stopping rearward movement of said receptacle on said tilted receptacle support surface, after said switch has been operated and before the receptacle touches the housing or bends the lever or does other damage.

6. The apparatus of claim 5, in which the backstop means comprises an inverted generally U-shaped member secured by downward extending legs of the U-shaped being fastened to the receptacle rest, with the base of the U-shaped being a transverse generally horizontal member spanning across the dispenser behind all of the combination beverage probe and dispensing actuator levers on a plurality of said dispensing valves.

7. The apparatus of claim 6, in which the backstop is inclined forward with respect to the tilted receptacle support surface.

8. The apparatus of claim 5, in which the backstop has a di-electric outer surface.

9. An improved cup and pitcher rest for a beverage dispenser, comprising (a) a generally planar inclinded upward facing receptacle support surface for cups and pitchers;

(b) front and rear rest support means for engaging the dispenser and positioning the receptacle support surface in a rearwardly inclined position;

(c) a nose on said support surface, said nose being generally co-planar with said receptacle support surface and extending upward and outward beyond said front rest support means and being the highest part of said support surface, and (d) means extending upward from said front support for vertical support of said nose and a pitcher resting at least inpart upon said nose and forward of said front support.

10. The apparatus of claim 9, in which the rest support means are a pair of spaced apart transverse members, and the nose is the blunted tip of an acute angle between the receptacle support surface and the vertical support means, with distal ends of the support surface and the support means being secured to the rear and front transverse members respectively.

11. The apparatus of claim 9, including a receptacle backstop secured to the rest, said backstop having a forward facing stop surface spaced well above the receptacle support surface.

12. An improved cup and pitcher rest for a beverage dispenser comprising (a) a generally planar inclined upward facing receptacle support surface for cups and pitchers;

(b) rest support means for engaging the dispenser and positioning the receptacle support surface in a rearwardly inclined position; and (c) a forward facing backstop for any beverage receptacle from a pre-determined group of cups and a pitcher, said backstop being spaced above and being directly over the rear and lower part of the inclined receptacle support surface, said backstop having a forward facing surface for engaging the cup or pitcher well above the inclined support surface.

13. The apparatus of claim 12, in which the backstop is inclined forward with respect to the receptacle support surface.

14. The apparatus of claim 12, in which the backstop is an inverted U-shape having an elevated rod extending across the width of the receptacle rest and a pair of downward extending side legs fastened one to each side of the receptacle rest.

15. A kit for retrofitting a cold carbonated beverage dispenser for filling cups into an improved beverage dispenser which will fill any receptacle from a predetermined receptacle group of cups and a pitcher, and which receptacle is filled to or adjacent to its upper rim, comprising (a) an electrically conductive elongate combination beverage probe and dispensing actuator lever engageable against the upper rim of said any receptacle and for a beverage dispensing valve, said probe having an electrical terminal and means for actuating a dispensing switch;

(b) an electronic control for being electrically connected in combination with a solenoid controlling the dispensing valve and a dispensing switch which is actuatable by the combination beverage probe and dispensing actuator lever, said control having means for electrically sensing when the dispensed beverage in the receptacle reaches or approaches the receptacle upper rim and touches the probe, said control further having means for stopping dispensing upon such sensing; and (c) a receptacle rest installable upon a drip tray of the dispenser, said receptacle rest having an inclined upper receptacle support surface with a rearward tilt towards the combination beverage probe and dispensing actuator lever, and means extending forward of and upright beyond the front rim of the drip tray for support of the pitcher above and at least partially to the outside of the drip tray.

16. The apparatus of claim 15, including a receptacle backstop spaced up above and standing up off of the inclined receptacle support, and in which the combination beverage probe and dispensing actuator lever is pivotable in a rearward swing which extends over and past the top of the backstop.

17. The apparatus of claim 15, in which said pitcher supporting means includes an acute angle nose at the intersection of the receptacle support surface and a vertical support extending downward and rearward from the nose.

18. A method of retrofitting a cold carbonated beverage dispenser for filling cups into an improved beverage dispenser which will fill any receptacle from a predetermined receptacle group of cups and a pitcher of larger capacity than any of the cups and which will automatically shut off when said any receptacle is filled to or adjacent to its upper rim, comprising the steps of (a) removing the existing cup rest and at least one of the existing beverage dispensing valve actuators from the dispenser;

(b) replacing the removed actuator with an electrically conductive combination beverage probe and dispensing actuator lever for engaging the upper rim of said receptacle;

(c) installing an electronic control electrically in combination with said probe and in lever and together with a solenoid for controlling dispensing, said control having means for electrically sensing the dispensed beverage when it reaches or approaches the receptacle upper rim and touches the probe, said control further having means for shutting off dispensing in response to said sensing, and (d) replacing the removed cup rest with an improved cup and pitcher rest having an inclined upper beverage receptacle support surface with a rearward tilt toward the probe, and a nose which extends forward of and upward beyond a front rim of a drip tray of the dispenser for support of the pitcher above and outside of the drip tray.

19. The method of claim 18, including the further step of installing a receptacle backstop which is under the probe and lever and which is spaced above and which is relatively fixed with respect to the dispenser, when installed, for preventing filled pitchers from sliding down and rearward on the inclined receptacle support surface.

20. A method of retrofitting a cold carbonated beverage dispenser for filling cups into an improved beverage dispenser which will fill any receptacle from a predetermined receptacle group of cups and a pitcher which is larger in capacity than any of the cups, and which will automatically shut off when said receptacle is filled to or adjacent to its upper rim, comprising the steps of (a) removing the existing cup rest and at least one of the existing beverage dispensing valve actuators from the dispenser;

(b) replacing the removed actuator with an electrically conductive combination beverage probe and dispensing actuator lever for engaging the upper rim of said receptacle;

(c) installing an electronic control electrically in combination with said probe and a solenoid for controlling dispensing, said control having means for electrically sensing the dispensed beverage when it reaches or approaches the receptacle upper rim and touches the lever, and probe, said control further having means for shutting off dispensing in response to said sensing; and (d) replacing the removed cup rest with an improved cup and pitcher rest having an inclined upper beverage receptacle support surface with a rearward tilt toward the lever, and (e) installing a cup and pitcher backstop which is fixed with respect to the cup and pitcher rest and which is spaced above the upper receptacle support surface and below the combination probe and lever and which is forward of a splash panel on the dispenser and behind the combination probe and lever.

21. A method of dispensing beverage into any receptacle from a pre-determined group of cups and a pitcher which is of greater size and capacity than any of the cups with automatic shut off of the dispensing, comprising the steps of (a) placing any one beverage receptacle from a predetermined grouping of different sized beverage cups and a pitcher which is significantly larger in size and capacity than any of the cups, upon a rearwardly inclined receptacle support surface and tilting the receptacle to the rear;

(b) moving the rearwardly tilted receptacle rearward and downward upon the support surface and (1) against and into a movable electrically conductive combination beverage probe and dispensing actuator lever to start dispensing, and (2) against a cup and pitcher backstop spaced from and in between the support surface and the lever and positively stopping downward movement of the receptacle;

(c) electrically sensing the dispensed beverage with the probe and lever as the beverage level reaches or approaches an upper rim of the receptacle and touches the probe, and terminating dispensing upon such sensing; and (d) holding the filled cup or pitcher in place upon the inclined support surface with the backstop so that the weight of the filled cup or pitcher cannot further move the lever.

22. The method of claim 21, including the steps of moving the electrically conductive probe and lever over the backstop and positively stopping rearward movement of the receptacle and the lever by engaging the receptacle with the backstop.

23. An improved beverage dispenser for filling any receptacle taken from a predetermined group of cups or glasses and a pitcher which is significantly larger in size and volume than any of the cups or glasses, comprising taken from a pre-determined group of cups or glasses and a pitcher which is significantly larger in size and volume than any of the cups or glasses, comprising (a) a dispenser housing having a drip tray mounted thereto and an electrically actuatable dispensing valve above the drip tray;

(b) means on said dispenser for starting dispensing of beverage into the receptacle upon placement of the receptacle into a tilted filling position below the dispensing valve;

(c) a receptacle support above the drip tray, said receptacle support having an inclined upper receptacle support surface which extends upward above and outward beyond a front rim of the drip tray for support of the pitcher above the tray front rim and at least partially outside of the drip tray with the pitcher being tilted rearward toward the housing;

(d) means for abutting against and supporting the pitcher on the inclined surface, so the pitcher does not slide downward into the housing, and (e) means for automatically shutting off dispensing when the level of dispensed beverage in the receptacle reaches or approaches the lowest level of the upper rim of the receptacle, regardless of the type of the said any receptacle.

* * * * *